US006570577B1

(12) United States Patent
Callway et al.

(10) Patent No.: US 6,570,577 B1
(45) Date of Patent: May 27, 2003

(54) SYSTEM FOR NONLINEAR CORRECTION OF VIDEO SIGNALS AND METHOD THEREOF

(75) Inventors: Edward G. Callway, Toronto (CA); David I. J. Glen, Toronto (CA)

(73) Assignee: ATI International SRL (BB)

( * ) Notice: Subject to any disclaimer, the term of this patent is extended or adjusted under 35 U.S.C. 154(b) by 0 days.

(21) Appl. No.: 09/557,094

(22) Filed: Apr. 21, 2000

(51) Int. Cl.[7] ..... G09G 5/04

(52) U.S. Cl. ..... 345/604

(58) Field of Search ..... 345/589, 590, 345/591, 600, 603, 604, 690; 348/34, 441, 488, 603, 674, 690, 691, FOR 144, 71, 687

(56) References Cited

U.S. PATENT DOCUMENTS 5,774,112 A * 6/1998 Kasson ..... 345/153

* cited by examiner

*Primary Examiner*—Kee M. Tung
*Assistant Examiner*—G. F. Cunningham
(74) *Attorney, Agent, or Firm*—Vedder, Price, Kaufman & Kammolz

(57) ABSTRACT

In accordance with an embodiment of the present invention a digital representation of a YCbCr video signal data stream is received that represents a video image or a series of video images. Received Y data values are linearly transformed and used to provide an RGB signal. The RGB signal is non-linearly adjusted to provide an adjusted RGB signal that enhances the viewed brightness of the data. In a specific embodiment, the non-linear adjusting adjusts the brightness of data near a mid-range of the video image more than other ranges of data.

18 Claims, 4 Drawing Sheets

SYSTEM FOR NONLINEAR CORRECTION OF VIDEO SIGNALS AND METHOD THEREOF

FIELD OF THE INVENTION

The present invention relates generally to displaying video signals, and more specifically to a method and system for enhanced YCbCr to RGB conversion of received video signals for display on a RGB interface based graphics monitor.

BACKGROUND OF THE INVENTION

The color space defined by standard recommendation ITU-R BT.601 is referred to as YCbCr data. Y represents the luma component, while the Cb and Cr represents color difference components. YCbCr data is generally associated with television video data that has been digitized by a television receiver. YCbCr is also the common form of video data output from an MPEG decoder, such as a DVD-video player. YCbCr data is most often eight-bit data words, where the YCbCr definition defines nominal white of Y to be the value 235, and black to be any value of Y between 0 and 16. Another common form of YCbCr uses 10 bit data words, with Y's nominal white value at 940, and black is from 0 to 64.

Note, the term black is used herein with reference to one word of one video component, and means that the video component is not generated (i.e. a value of 0–16 for Y or a value of 0 for R, G, and B). The term maximum white is used herein to specify a maximum "on" value for a video component (i.e. a value of 255 for Y, or a value of 255 for R, G, and B).

The YCbCr definition of nominal white defines a value, that when displayed on a television monitor would be considered white by most people. However, while the value 235 is defined as nominal white, it is possible for YCbCr data to provide colors brighter than nominal white by providing the values 236–255 for 8 bit data, and from 940 to 1023 for 10 bit data.

It has become desirable to display YCbCr data on RGB graphics monitors, generally used with computers, as opposed to RGB video monitors, which are generally used in television applications. Typically, RGB video monitors are those display devices that receive data in an RGB format where a nominal white value (235) is less than a maximum white value (255), while RGB graphics monitors are those display devices that receive data in an RGB format where a nominal white value (255) is equal to a maximum white value (255). RGB graphics monitors are typically adjusted to produce less brightness than RGB video monitors, thereby resulting in video images that have a dim appearance for most viewers.

In order to accommodate the display of video signals on RGB graphics monitors, a conversion including color space conversion and amplitude scaling has been performed from the YCbCr range of 16–235 (black to nominal white) to the RGB range of 0–255 (black to maximum white). However, as previously mentioned the definition of nominal white for YCbCr space is different than the definition of maximum white for RGB space. Therefore, while RGB nominal white is a maximum white value, the YCbCr nominal white merely refers to a value, which when displayed on a television monitor can produce a color considered to be nominal white, although not a maximum white. The YCbCr definition permits the display of whites that are brighter than nominal white in the range of 236 through 255. Therefore, a simple scaling between black and nominal white results in a loss of detail in areas that are brighter than nominal white, due to the required signal clamping at 255.

One effort to resolve the loss of near white data has been to provide amplitude linear transforming of the Y component beyond the nominal white range of 235, resulting in a loss of less of the brighter than nominal white YCbCr data. However, because of the characteristics of RGB graphics monitors, data scaled in this manner, results in the overall display of video on an RGB graphics display to be darker than desirable for most viewers.

Therefore, a system and method capable of performing YCbCr to RGB data conversion scaling that overcomes problems associated with the prior methods would be useful.

DETAILED DESCRIPTION OF THE FIGURES

In accordance with an embodiment of the present invention a digital representation of a YCbCr video signal data stream is received that represents a video image or a series of video images. Received Y data values are linearly transformed and used to provide an RGB signal. The RGB signal is non-linearly adjusted to provide an adjusted RGB signal that enhances the brightness of the data. In a specific embodiment, the non-linear adjustment enhances the brightness of data near a mid-range of the video image more than other ranges of data.

Figure 1:
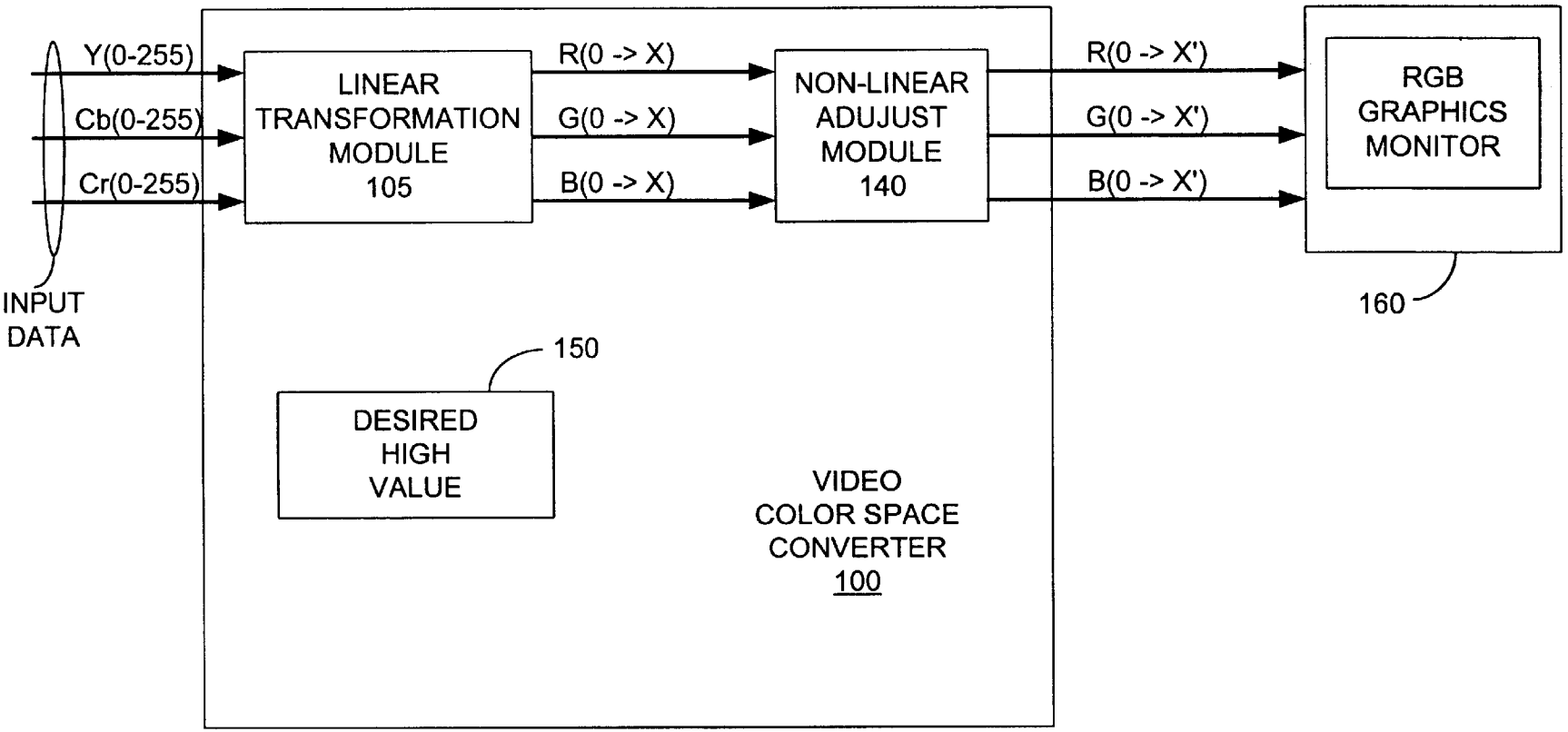
FIG. 1 illustrates, in block diagram form, a system for converting a received video signal.

The present invention is best described with reference to FIGS. 1–4. FIG. 1 illustrates, in block diagram form, a system comprising a video scalar 100 for receiving YCbCr input data and for providing RGB output data. The RGB output data is received by the RGB graphics monitor 160 for display.

Note for purposes of discussion herein nominal white assumes that Y=235, and Cb=Cr=128, and that brighter than nominal white assumes Y>235, and Cb=Cr=128. Further more, it will be understood by one of ordinary skill in the art that this discussion extend to non-white color cases where Y>=235, and Cb and Cr are different than 128. Furthermore, the linear transforming of Y is such that when YCbCr is converted to RGB, assuming Cb=Cr=128, the range of Y=16 . . . 235 is converted to the range of R=G=B=0 . . . 255. Y values greater or less than the minimum Y range value and the maximum Y range value are clamped to the minimum and maximum Y range values respectively.

FIG. 1 illustrates a video color space converter 100. The converter 100 includes a linear conversion module 105 that performs a linear transformation of YCbCr data to RGB data. This transformation can include amplitude scaling, converting, and offsetting of the Y data component of the received YCbCr data stream. The generated RGB data stream is received by a non-linear adjust module 140 prior to being provided to the RGB graphics monitor 160. A module 150 represents a variable component that supports various conversions based upon a desired high value. The module 150 can include a register value, or a table of matrix multiplier coefficients which are associated with various desired high values.

The operation of the converter 100 will be described with reference to FIG. 2. The module 105 receives YCbCr data as an input. Each YCbCr component of the received data is converted to RGB data space value based upon a Desired High-Value (DHV).

The DHV is a value of Y that is to be scaled to the maximum RGB white value of 255. In a specific embodiment, the DHV is greater than Y nominal white (235) and less than Y maximum white (255). FIG. 2 illustrates two specific transform curves that can be implemented by the module 105. Note that R=B=G since the discussion herein has been limited to gray scale (i.e. Cb=Cr=128).

Curve 101 represents a transform curve associated with a first DHV value (DHV1). As illustrated, any Y data value greater than black (16) and less than maximum white (DHV1) is transformed into a RGB value between 0 and respectively X, where X can be 255 for 8-bit data, 1023 for 10-bit data, or any other value representing a maximum value for an RGB component. As illustrated, for a Y input value less than 16 the conversion clamps the resulting RGB data space value to 0. For a Y input value greater than DHV the conversion clamps the resulting RGB data space to X (eg. X=255 for 8-bits).

Figure 2:
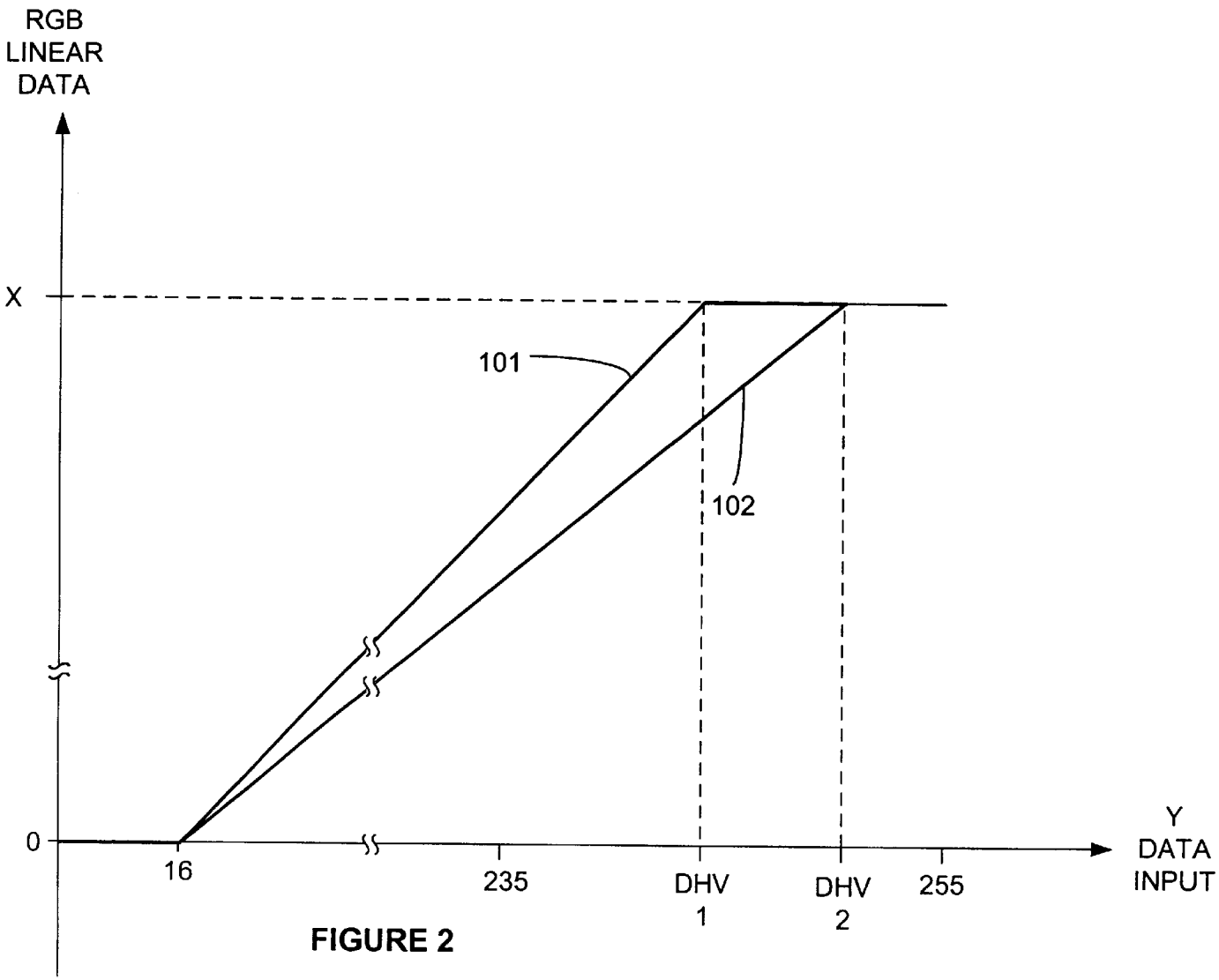
FIGS. 2–3 illustrate, in graphical form, various transform functions in accordance with a present invention.

It will be appreciated by one of ordinary skill in the art, that the transform curve 101 of FIG. 2 represents several functions that may be performed in a single operation, or multiple operations. For example, data clamping and scaling the desired data range (0–DHV1) to RGB space (0–255) are performed by the curves of FIG. 2.

Curve 102 represents a transform curve associated with a second DHV value (DHV2). As illustrated, any Y data value greater than black (16) and less than maximum white (DHV2) is transformed into a RGB value between 0 and respectively X. As illustrated, for a Y input value less than 16 the conversion clamps the resulting RGB data space value to 0. For a Y input value greater than DHV the conversion clamps the resulting RGB data space to X.

The resulting RGB data is provided to the non-linear adjust module 140. Operation of the non-linear adjust module is described with reference to FIGS. 3 and 4.

Figure 3:
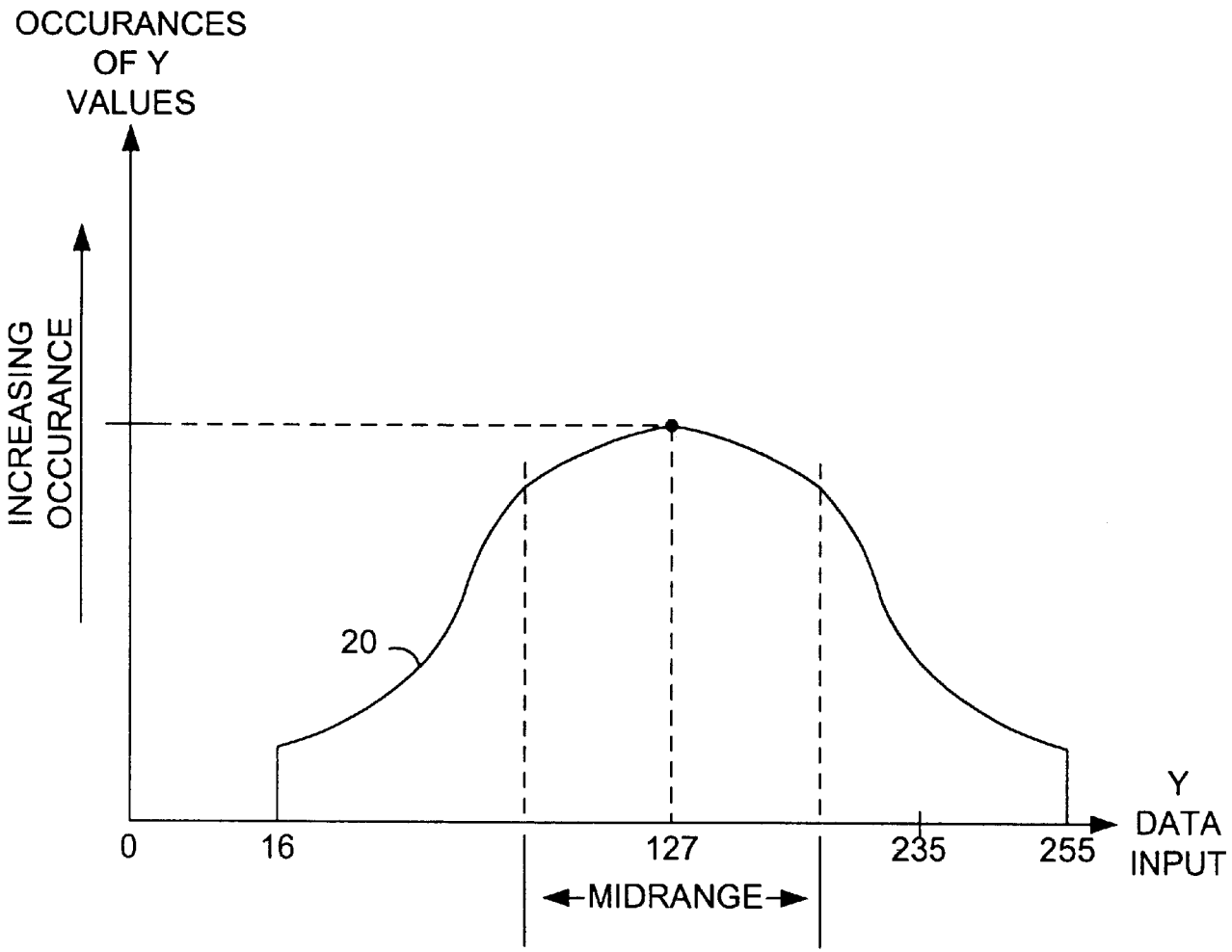

FIG. 3 represents a typical distribution of Y data values associated with a YCbCr data stream. As illustrated, a greater distribution of Y data typically occurs near the midrange of the YCbCr data range as opposed to the data ranges near black (clamped 16) or near maximum white (255). Through the use of non-linear adjusting, values near the mid-range can be adjusted to enhance the overall brightness of the viewed image.

Figure 4:
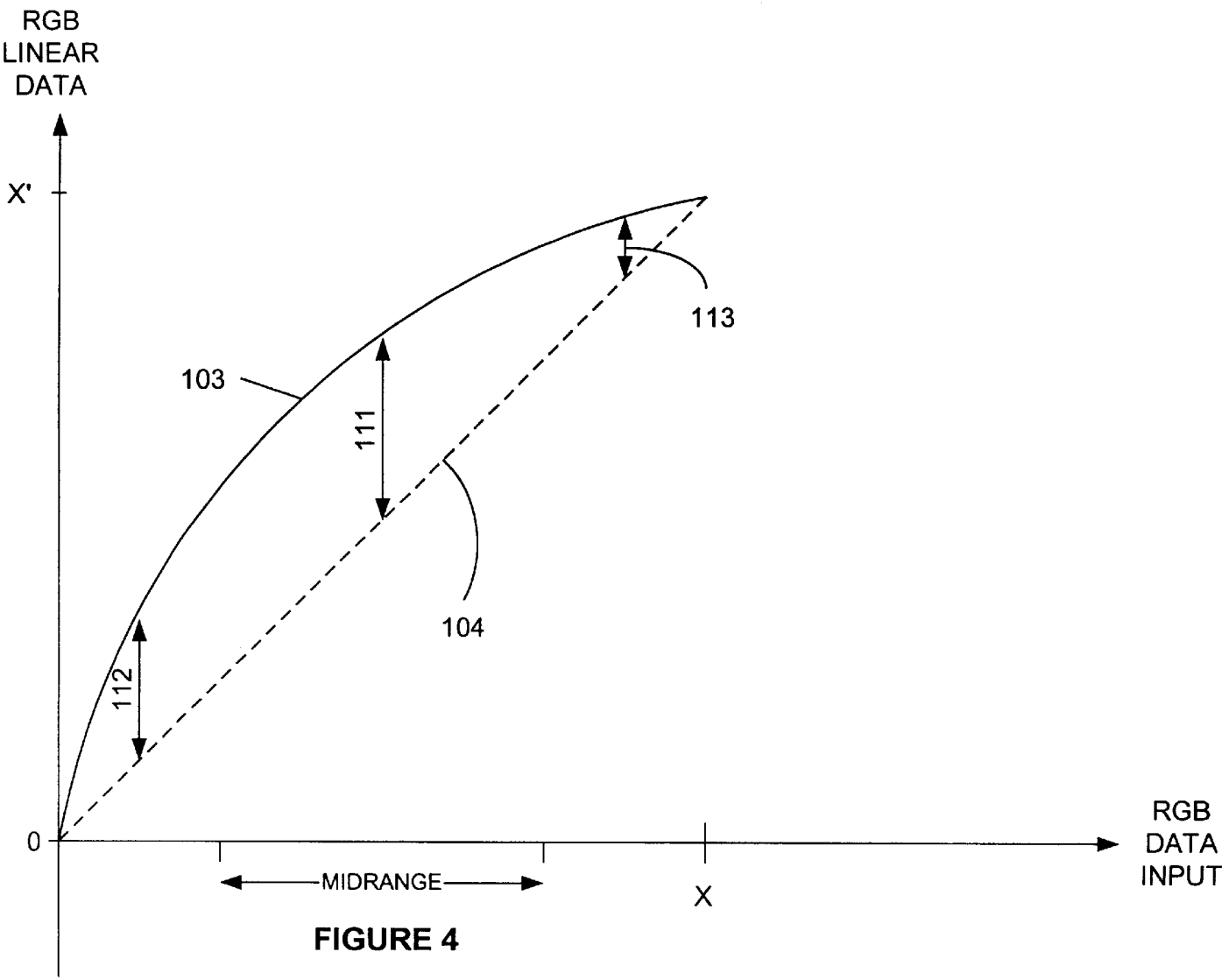
FIG. 4 illustrates, in graphical form, a non-linear adjust function in accordance with one embodiment of the present invention.

FIG. 4 illustrates a non-linear curve 103 that scales the RGB data values such that the mid range RGB values are incremented by a greater amount than the RGB end ranges. For example, line 111 represents the amount a specific RGB value (eg. 128 for 8-bit RGB) near the midpoint RGB range is incremented; line 112 represents the amount a specific RGB value near the black end is incremented; line 113 represents the amount a specific RGB value near the maximum white end is incremented. Note, line 104 is a unity transform curve representing no change in RGB value. As illustrated, the magnitude of 111 is greater than the magnitude of either 112, or 113.

By providing non-linear adjusting to the resulting RGB image, an image with enhanced brightness is provided to the RGB monitor. This image, when displayed, is more appealing to a typical viewer.

One of ordinary skill in the art will recognize that many alternative embodiments of the present invention can be anticipated. For example, the choice of DHV values, and various non-linear curves can be specified either manually by a user, or automatically by application or driver software. In an alternate embodiment, a non-linear conversion in YCbCr space can be performed prior to the described linear conversion. In addition, the method of clamping Y values in the range near nominal black may be changed without significantly affecting the preservation of detail in areas brighter than nominal white using the method discussed here.

It should be further understood that the specific module functions described herein may be implemented in hardware and/or software. For example, a specific step or function may be performed using software and/or firmware executed on one or more processing modules.

Typically, a system for non-linear correction of video signals will include generic or specific processing modules and memory. The processing modules can be based on a single processing device or a plurality of processing devices. Such a processing device may be a microprocessor, microcontroller, digital processor, microcomputer, a portion of a central processing unit, a state machine, logic circuitry, and/or any device that manipulates the signal.

The manipulation of these signals is generally based upon operational instructions represented in a memory. The memory may be a single memory device or a plurality of memory devices. Such a memory device (machine readable media) may be a read only memory, a random access memory, a floppy disk memory, magnetic tape memory, erasable memory, a portion of a system memory, or any other device that stores operational instructions in a digital format. Note that when the processing module implements one or more of its functions, it may do so where the memory storing in the corresponding operational instructions is embedded within the circuitry comprising a state machine and/or other logic circuitry.

It should be apparent that the present invention is advantageous over the prior art. In addition, it will be apparent that many variations to the specific embodiments would be anticipated. For example, in addition to a DHV specifying a maximum white value, the same methodology can be used to specify a desired low value (DLV), which would indicate a specific Y value below which all data is black. The use of a DLV would allow a black value greater or less than 16 to be specified.

We claim:

1. A method of processing video data for display on a graphics monitor, the method comprising the step of:

receiving a digital representation of a portion of a first video signal;

linearly transforming the digital representation to provide a first adjusted digital representation wherein detail above a nominal white value is maintained; and non-linearly adjusting the first adjusted digital representation to provide a second adjusted digital representation.

2. The method of claim 1, wherein the step of non-linearly adjusting further includes non-linearly adjusting the first adjusted digital representation to provide a second adjusted digital representation wherein the overall brightness of the image is enhanced and the detail above the nominal white value is also maintained.

3. The method of claim 1 further comprising the step of:

providing the second adjusted digital representation to an output port to be coupled to a display device.

4. The method of claim 3, wherein the display device is a RGB (red green blue) graphics monitor.

5. The method of claim 1, wherein the first adjusted digital representation includes a plurality of first pixels representing a frame of video data; and the step of non-linearly adjusting provides the second adjusted digital representation by adjusting each one of the first plurality of pixels to one of a corresponding plurality of second pixels, wherein a majority of the corresponding plurality of second pixels have a greater brightness than their corresponding pixel in the first plurality of pixels.

6. The method of claim 1, wherein:

the step of receiving a digital representation further includes the digital representation being in a first range; and the step of linearly transforming further includes the sub-steps of:

when the value of the digital representation is in a second range:

converting the value of the digital representation to a third range to form the first adjusted digital representation, wherein the second range comprises a second range low value that is greater than the first range low value, and a second range high value that is greater than the first range nominal white value;

the second range is mapped substantially linearly across the third range, wherein the third range extends from a third range low value to a third range high value and includes a third range nominal white value corresponding to the first range nominal white value.

7. The method of claim 6 wherein the step of linearly transforming further includes:

when the value of the digital representation is in a fourth range:

converting the value of the digital representation to a predetermined value.

8. The method of claim 7, wherein the predetermined value is equal to the third range low value.

9. The method of claim 8, wherein the fourth range is from the first range low value to the second range low value.

10. The method of claim 7, wherein the predetermined value is equal to the third range high value.

11. The method of claim 10, wherein the fourth range is from the second range high value to the first range high value.

12. A system for processing video data for displaying on a graphics monitor, the system comprises:

a processing module; and memory operably coupled to the processing module, wherein the memory stores operational instructions that cause the processing module to:

receive a digital representation of a portion of a first video signal;

linearly transform the digital representation to provide a first adjusted digital representation wherein detail above a nominal white value is maintained; and non-linearly adjust the first adjusted digital representation to provide a second adjusted digital representation.

13. The system of claim 12 further includes storing operational instructions that cause the processing module to:

provide the second adjusted digital representation to an output port to be coupled to a display device.

14. The system of claim 13, wherein the display device is a RGB (red green blue) graphics monitor.

15. The system of claim 12 wherein the first adjusted digital representation includes a plurality of first pixels representing a frame of video data; and the step of non-linearly adjusting provides the second adjusted digital representation by adjusting each one of the first plurality of pixels to one of a corresponding plurality of second pixels, wherein a majority of the corresponding plurality of second pixels have a greater brightness than their corresponding pixel in the first plurality of pixels.

16. A machine readable media, comprising:

a plurality of machine executable instructions for receiving a digital representation of a portion of a first video signal;

a plurality of machine executable instructions for linearly transforming the digital representation to provide a first adjusted digital representation wherein detail above a nominal white value is maintained; and a plurality of machine executable instructions for non-linearly adjusting the first adjusted digital representation to provide a second adjusted digital representation.

17. The machine readable media of claim 16 further comprising a plurality of machine executable instructions for providing the second adjusted digital representation to an output port to be coupled to a display device.

18. The machine readable media of claim 16, wherein the plurality of instructions for non-linearly adjusting provides the second adjusted digital representation that is in a RGB (red green blue) format.

* * * * *